US005221810A

United States Patent [19]

Spahn

[11] Patent Number: 5,221,810

[45] Date of Patent: Jun. 22, 1993

[54] EMBEDDED CAN BOOSTER

[75] Inventor: Patrick F. Spahn, Silver Spring, Md.

[73] Assignee: The United States of America as represented by the Secretary of the Navy, Washington, D.C.

[21] Appl. No.: 882,722

[22] Filed: May 14, 1992

[51] Int. Cl.[5] ..... F42B 1/028

[52] U.S. Cl. ..... 102/475; 102/305; 102/473; 102/499; 102/701

[58] Field of Search ..... 102/200, 204, 205, 305, 102/306, 307, 309, 473, 475, 476, 499, 500, 701

[56] References Cited

U.S. PATENT DOCUMENTS

| | | | |
|---|---|---|---|
| 3,561,361 | 2/1971 | Kessenich | 102/476 |
| 4,050,381 | 9/1977 | Heinemann | 102/476 |
| 4,213,391 | 7/1980 | Drimmer | 102/701 |
| 4,425,850 | 1/1984 | Grossler | 102/476 |

FOREIGN PATENT DOCUMENTS

| | | | |
|---|---|---|---|
| 172647 | 2/1986 | European Pat. Off. | 102/499 |
| 1131081 | 2/1957 | France | 102/473 |
| 1531538 | 7/1968 | France | 102/476 |

*Primary Examiner*—Harold J. Tudor
*Attorney, Agent, or Firm*—John D. Lewis; Roger D. Johnson

[57] ABSTRACT

In an explosive device having a main charge explosive, a booster explosive embedded in the main charge explosive, and a detonator, a can or plate is embedded in the main charge explosive and provides a high impedance surface which is shaped and oriented so that shock waves from the booster explosion will strike the high impedance surface at normal incidence and be reflected back toward the booster explosion. This increases the pressure in the main charge explosive material between the booster explosive and the can or plate, thus increasing the effectiveness of the booster explosive.

4 Claims, 1 Drawing Sheet

EMBEDDED CAN BOOSTER

BACKGROUND OF THE INVENTION

This invention relates to explosive devices and more particularly to booster/fuse systems for explosive devices.

To reduce the chance of accidental explosions and fires, the Navy, Air Force, and Army are replacing existing main charge explosives with new, more insensitive explosives such as PBXN-103 and PBXN-109. Additionally, future underwater and bombfill explosives will have critical diameters greater than one inch. Existing booster explosives and fuses have insufficient energy output to reliably initiate the new insensitive main charge explosives. Increasing the amount of booster explosive will increase the weapon's sensitivity and the chance of an accidental detonation. Moreover, the existing Department of Defense (DOD) inventory of fuses and booster explosives is very large and cannot be replaced without considerable cost. What is needed is an inexpensive method of reliably initiating the new, more insensitive main charge explosive while at the same time reducing the chance of the accidental initiation of a fuse booster system.

SUMMARY OF THE INVENTION

Accordingly, an object of this invention is to improve the reliability of operation of fuse/booster explosive initiating systems in explosive devices.

Another object of this invention is to improve the safety of explosive warheads and bombs.

A further object of this invention is to reduce the amount of booster explosive required for explosive warheads and bombs.

Still another object of this invention is to reduce the cost of modify existing explosive warhead systems with safer, more insensitive main charge explosives.

These and other objects of this invention are achieved by providing:

In an explosive device having a main charge explosive, a booster explosive embedded in the main charge explosive, and a detonator to set off the booster explosive, the improvement of embedding in the main charge explosive a can that surrounds the sides of the booster explosive or a plate that faces the booster explosive, wherein the can or plate provides a high impedance surface that faces the booster explosive and is shaped and oriented so that shock waves from the booster explosion will strike the high impedance surface at normal incidence and be reflected back toward the booster explosion, thus increasing the pressure in the portion of the main charge explosive that was between the high impedance surface and the booster explosion to the point that this portion of the main charge explosive is initiated which in turn initiates the rest of the main charge explosive.

BRIEF DESCRIPTION OF THE DRAWINGS

A more complete appreciation of this invention and many of the attendant advantages thereof will be readily appreciated as the same becomes better understood by reference to the following detailed description when considered in connection with the accompanying drawings:

FIGS. 1 and 2 are not drawn to scale.

DETAILED DESCRIPTION OF THE PREFERRED EMBODIMENT

In the present invention a high impedance material is used to reflect booster explosive shock waves back upon themselves. This is done to generate higher than Chapman-Jouget pressures in the portion of the insensitive main charge explosive located between the high impedance material and the booster explosive area and thus initiate the main charge explosive. This invention is particularly useful as a means of initiating insensitive main charge explosives having critical diameters greater than 1 inch. The critical diameter for an explosive is the minimum diameter mass of that explosive that can be detonated without being heavily confined.

The high impedance material is in a shape designed to provide a high impedance surface normal to the shock waves generate by a properly detonated booster explosive. Note, an accidental detonation is likely to be initiated in a manner that will produce few shock waves that are normal to the high impedance surface. The two preferred types of structures are the plate and the can.

Figure 1:
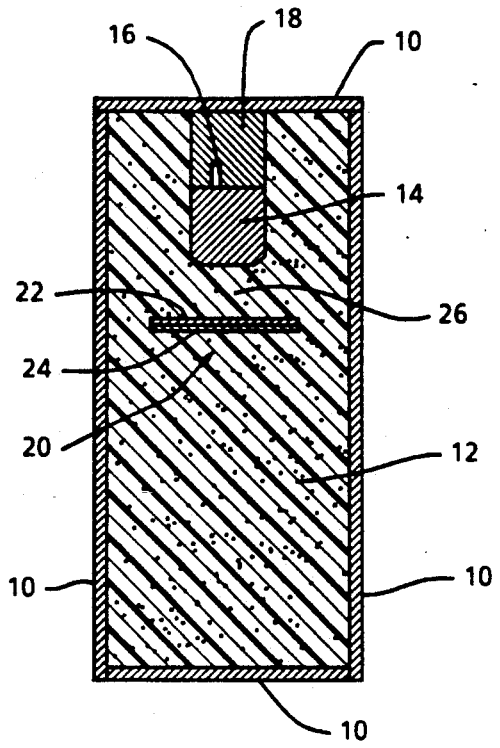
FIG. 1 is a schematic representation of a cross-sectional side view of an explosive device in which a high impedance plate is embedded in a main charge explosive and face and is normal to a booster explosive.

FIG. 1 is a schematic representation of a cross-sectional side view of an explosive device using an embedded plate. In FIG. 1, an outer case 10 encloses an insensitive main charge explosive 12. Embedded in one end of the main charge explosive 12 is a booster explosive 14 with a detonator 16 and fusing device 18. A high impedance plate 20 is also embedded in the main charge explosive 12 and is designed and placed to provide a high impedance surface 22 which faces and is shaped and oriented so that the shock waves from the exploding booster explosive 14 will strike the high impedance surface 22 at normal incidence. The high impedance plate 20 is located at a distance from the booster explosive 14 of preferably from about 1/7 to about $\frac{3}{4}$, more preferably from $\frac{1}{3}$ to $\frac{3}{4}$, and still more preferably from $\frac{1}{2}$ to $\frac{3}{4}$ of the critical diameter of the insensitive main charge explosive 12. The zone 26 between the high impedance plate 20 and the booster explosive 14 is fill with main charge explosive 12 and is the place where the main charge explosive 12 will be initiated. Because most warheads, torpedoes, shells, and bombs are cylindrical, the outer case 10, insensitive main explosive 12, and booster explosive 14 will usually be cylindrical. In that case, the high impedance plate 20 will preferably be a round disc. To help insure the proper functioning of the explosive device, the distance between the edge of the high impedance plate 20 and the outer case 10 should be at least as great as the distance between the high impedance plate 20 and the bottom surface of the booster explosive 14. As a practical matter, for most devices it will usually be greater. Optionally, the surface of the plate 20 away from the booster explosive 14 may be covered with a layer of low impedance material 24 to reduce the chance of accidental detonation of the booster explosive 14 from stray shock waves.

Referring again to FIG. 1, upon detonation of the booster explosive 14, shock waves travel out and strike the high impedance surface 22 of the plate 20 at normal incidence and are reflected back on themselves, resulting in pressures in the zone 26 that are nearly double what they would have been without the plate 20. When these pressures exceed the Chapman-Jouget pressure, the insensitive main charge explosive in the zone 26 is initiated, followed by the initiation of the remainder of the insensitive main charge explosive 12.

Figure 2:
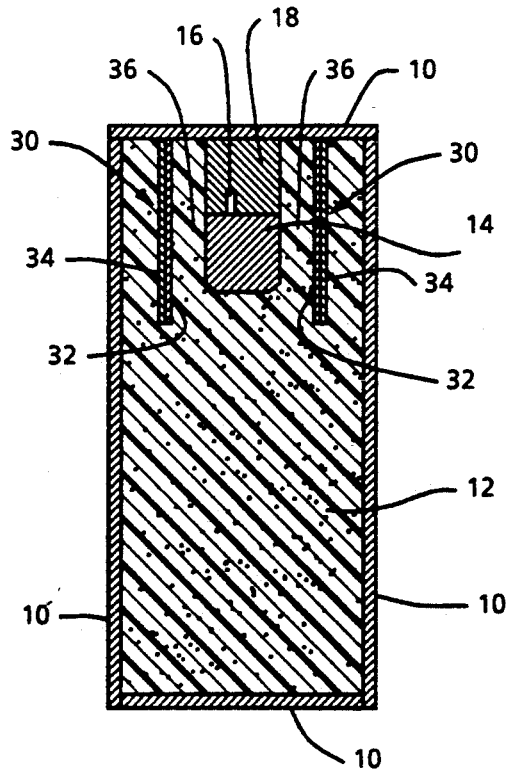
FIG. 2 is a schematic representation of a cross-sectional side view of an explosive device in which a high impedance g hollow cylinder (can) is embedded in a main charge explosive and surrounds the booster explosive.

FIG. 2 is a schematic representation of a cross-sectional side view of an explosive device using an embedded cylindrical can. In FIG. 2, an outer case 10 encloses an insensitive main charge explosive 12. Embedded in one end of the main charge explosive 12 is a cylindrical booster explosive charge 14 with a detonator 16 and fusing device 18. A high impedance can 30 in the shape of a hollow cylinder open at the bottom is also embedded in the main charge explosive 12 and encircles the cylindrical booster explosive charge 14. The high impedance inner surface 32 of the high impedance hollow cylindrical can 30 faces and is shaped and oriented so that the shock waves from the sides exploding cylindrical booster explosive charge 14 will strike the high impedance inner surface 32 at normal incidence. The distance between the high impedance surface 26 and the cylindrical booster explosive charge 14 is preferably from about 1/7 to about $\frac{3}{4}$, more preferably from $\frac{1}{3}$ to $\frac{3}{4}$, and still more preferably from $\frac{1}{2}$ to $\frac{3}{4}$ of the critical diameter of the insensitive main charge explosive 12. The zone 36 between the surface of the cylindrical booster explosive charge 14 and the high impedance inner surface 32 of the high impedance hollow cylindrical can 30 is fill with insensitive main charge explosive 12. Optionally, the outer surface of the can 30 may be covered with a layer of low impedance material 34 to reduce the chance of the accidental detonation of the booster from stray shock waves.

Referring yet to FIG. 2, upon the detonation of the cylindrical booster explosive charge 14, shock waves radiate out to the high impedance surface 32, and are reflected back on themselves toward the booster explosive area, resulting in pressures in the zone 36 that are nearly double what they would have been without the high impedance surface 32 of the high impedance can 30. When these pressures exceed the Champman-Jouget pressure, the insensitive main charge explosive in the zone 36 is initiated, followed by the initiation of the remainder of the insensitive main charge explosive 12.

In order to provide a high impedance surface that the booster explosion shock waves will strike at normal incidence, a can should be the same shape as the booster explosive. It is also preferred that the distance between the high impedance inner surface of the can and the outer surface of the booster explosive be the same everywhere so that the booster explosive shock waves will travel the same distance and the pressure build ups will be close together. Although almost any shape is possible (rectangular, hexagonal, elliptical, etc.) the most common and most preferred shape for the booster explosive and the can is a cylinder.

The high impedance can or plate is made of any high impedance material such as a high impedance metal, metal alloy, ceramic, or plastic, etc. Steels are the more preferred high impedance materials because they are relatively inexpensive.

The outside surface of the can or the back surface of the plate facing away from the booster may be covered with a low impedance composite, ceramic, or layered material which decays the peak pressures associated with shocks from fragment impacts or sympathetic detonations. The can or embedded plate would also act to slow down fragments, bullets, or other particles which might otherwise strike the booster area and cause inadvertent detonation. In these ways the can or plate can be used to protect the booster/fuse area.

The weight of an explosive device can be reduced by omitting a portion of the embedded can and optionally the corresponding portion of the booster explosive. However, this will reduce the performance of the booster explosive. Therefore, this modification is limited to those situations where the full can booster explosive system generates more pressure than is needed to detonate the main charge and where weight reduction is important.

The present invention makes it simple to retrofit existing munitions (bombs, warheads, etc) with safer explosive fills without having to redesign the existing fuse/booster systems. Supplemental booster charges may also be fitted to the existing fuse/booster system to increase the booster power.

The high impedance cans or plates in this invention are used solely to reflect booster explosion shock waves in a way that enhances the performance of the booster explosive. This is contrary to plates that are used to focus or direct shock waves from the main charge explosive as in shape charges or similar explosive devices.

The general nature of the invention having been set forth, the following examples are presented as specific illustrations thereof It will be understood that the invention is not limited to these specific examples, but is susceptible to various modifications that will be recognized by one of ordinary skill in the art.

EXAMPLE 1

A detonator with a cylindrical PBXN-110 high energy explosive booster charge was used to attempt to initiate a PBXW-122 insensitive explosive main charge. The composition of PBXN-110 by weight is 86% cyclotetramethylenetetranitramine (HMX) AND 14% Binder. PBXW-122 has a critical diameter of 7 inches, which means that it cannot be detonated in less than a 7 inch diameter mass unless heavily confined. PBXW-122 has a sensitivity of 130 K bars (ELSGT). The composition of PBXW-122 by weight is 47% 3-nitro-1,2,4-triazol-5-one (NTO), 5% cyclotrimethylenetrinitramine (RDX), 20% ammonium perchlorate (AP), 15% aluminum, and 13% binder. A 3 inch high by 5 inch diameter cylindrical charge of PBXN-110 was required to initiate the 65 pounds of PBXW-122 main charge explosive.

EXAMPLE 2

With Plate

The procedure of Example 1 was repeated using a 3 inch high by 3 inch diameter cylindrical charge of the PBXN-110 booster explosive. A $\frac{1}{2}$ inch thick flat steel disc having a 3 inch diameter was embedded in the PBXW-122 main charge explosive parallel to the bottom of the PBXN-110 booster charge cylinder (normal to shock waves from the booster explosion). There was a 1 inch space filled with PBXW-122 between the top of the flat steel disc and the bottom of the PBXN-110 booster charge cylinder. The 3 inch by high 3 inch diameter cylinder of PBXN-110 with the steel disc successfully initiated the 65 pounds of PBXW-122 main charge explosive.

EXAMPLE 3

With Can

The procedure of Example 1 was repeated using a 3 inch high by 3 inch diameter cylindrical charge of the PBXN-110 booster explosive. A hollow steel cylinder having an outer diameter of 6 inches and an inner diameter of 5 inches was placed concentrically around the PBXN-110 cylinder so that there was a uniform 1 inch space between the PBXN-110 cylinder and the inner surface of the hollow steel cylinder all around (360°) the PBXN-110 cylinder. This space between the PBXN-110 cylinder and the inner surface of the hollow steel cylinder was filled with PBXW-122 main charge explosive. The 3 inch high by 3 inch diameter cylinder of PBXN-110 and hollow steel cylinder successfully initiated the 65 pounds of PBXW-122 main charge explosive.

In example 1 (without a plate) 235.6 cubic inches of PBXN-110 booster explosive was required to initiate the PBXW-122 main charge explosive. In example 2 (using a steel plate (disc) and in example 3 using a hollow steel cylinder (can) only 84.8 cubic inches of PBXN-110 was needed to initiate the PBXW-122. Thus, the amount of booster explosive was reduced by 64 percent by using a steel plate or a steel can.

Obviously, numerous modifications and variations of the present invention are possible in light of the above teachings. It is therefore to be understood that within the scope of the appended claims the invention may be practiced otherwise than as specifically described.

What is claimed is:

1. An explosive device comprising a) a main charge explosive, b) a cylindrical booster explosive charge embedded in the main charge explosive, c) a hollow cylindrical can with a high impedance, shockwave reflective inner surface and an open bottom, the can being embedded in the main charge explosive so that the can surrounds and is concentric with the cylindrical booster explosive charge and forms a uniform annular space between the inner surface of the hollow cylindrical can and the outer surface of the cylindrical booster explosive, the distance between these two surfaces being from about 1/7 to about $\frac{3}{4}$ of the critical diameter of the main charge explosive, the uniform annular space being filled with a minor part of the main charge explosive which is contiguous with the remaining major part of the main charge explosive which is located outside of the volume enclosed by the hollow cylindrical can; and d) means for detonating the booster explosive charge.

2. The explosive device of claim 1 wherein the distance from the outer surface of the cylindrical booster explosive charge to the high impedance inner surface of the hollow cylindrical can is from $\frac{1}{3}$ to $\frac{3}{4}$ of the critical diameter of the main charge explosive.

3. The explosive device of claim 2 wherein the distance from the outer surface of the cylindrical booster explosive charge to the high impedance inner surface of the hollow cylindrical can is from $\frac{1}{2}$ to $\frac{3}{4}$ of the critical diameter of the main charge explosive.

4. The explosive device of claim 1 wherein the outside surface of the hollow cylindrical can is covered with a low impedance material.

* * * * *